US008984693B2

(12) United States Patent
Ashrafzadeh et al.

(10) Patent No.: US 8,984,693 B2
(45) Date of Patent: Mar. 24, 2015

(54) METHOD AND APPARATUS FOR REDISTRIBUTING AN IMBALANCE IN A LAUNDRY TREATING APPLIANCE

(75) Inventors: Farhad Ashrafzadeh, Stevensville, MI (US); Brian P. Janke, Saint Joseph, MI (US); Peter J. Richmond, Berrien Springs, MI (US); Marcelo C. Silva, Joinville (BR); Rodrigo S. Teixeira, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 1006 days.

(21) Appl. No.: 12/964,763

(22) Filed: Dec. 10, 2010

(65) Prior Publication Data

US 2012/0144600 A1 Jun. 14, 2012

(51) Int. Cl.

| | |
|---|---|
| ***D06F 37/22*** | (2006.01) |
| ***D06F 33/02*** | (2006.01) |
| ***D06F 37/20*** | (2006.01) |

(52) U.S. Cl.

CPC ..... *D06F 37/203* (2013.01); *D06F 33/02* (2013.01)

USPC ..... 8/158

(58) Field of Classification Search

CPC .... D06F 37/203; D06F 37/22; D06F 2222/00

USPC ..... 68/12.06, 23.1, 24

See application file for complete search history.

(56) References Cited

U.S. PATENT DOCUMENTS

| | | | | |
|---|---|---|---|---|
| 3,640,098 | A | 2/1972 | Eastall | |
| 4,344,198 | A | 8/1982 | Arendt et al. | |
| 5,325,677 | A | 7/1994 | Payne et al. | |
| 5,671,494 | A | 9/1997 | Civanelli et al. | |
| 5,692,313 | A | 12/1997 | Ikeda et al. | |
| 5,765,402 | A * | 6/1998 | Ikeda et al. | 68/12.06 |
| 7,530,133 | B2 | 5/2009 | Mitts | |
| 8,302,232 | B2 * | 11/2012 | Bae et al. | 8/159 |
| 2006/0185095 | A1 * | 8/2006 | Mitts | 8/158 |
| 2007/0294838 | A1 * | 12/2007 | Croxton | 8/158 |
| 2008/0289118 | A1 | 11/2008 | Park et al. | |
| 2009/0249560 | A1 * | 10/2009 | Gaulter et al. | 8/158 |
| 2009/0307851 | A1 | 12/2009 | Bae et al. | |

FOREIGN PATENT DOCUMENTS

| | | | |
|---|---|---|---|
| EP | 0071308 | B1 | 5/1986 |
| EP | 0736625 | B1 | 11/1999 |
| EP | 0732437 | B1 | 7/2002 |
| FR | 2425494 | A1 | 12/1979 |
| GB | 2322141 | A | 8/1998 |
| GB | 2361715 | B | 10/2003 |
| WO | 2010072556 | A1 | 7/2010 |

* cited by examiner

*Primary Examiner* — Joseph L Perrin

(57) ABSTRACT

An apparatus and method for detecting an imbalance in the laundry load and effecting a redistribution of the imbalance by reducing the rotational speed of the treating chamber such that part of the load may redistribute while part of the load remains satellized, without ceasing rotation, and increasing the rotational speed back to a spin speed after redistribution.

14 Claims, 6 Drawing Sheets

METHOD AND APPARATUS FOR REDISTRIBUTING AN IMBALANCE IN A LAUNDRY TREATING APPLIANCE

BACKGROUND OF THE INVENTION

Laundry treating appliances, such as a washing machine in which a drum defines a treating chamber for receiving a laundry load, may implement cycles of operation. The cycles of operation may include different phases during which liquid is applied to the laundry load. The liquid may be removed from the laundry load during an extraction phase where the drum is rotated at speeds high enough to impart a centrifugal force on the load great enough to hold (a/k/a "plaster" or "satellize") the load to the peripheral wall of the drum (the clothes rotate with the drum and do not tumble) and extract liquid from the fabric items. During the acceleration to the extraction speed, the laundry may not distribute equally about the inner surface of the drum leading to an imbalance. If a sufficiently large enough load imbalance is present, the laundry treating appliance may experience undesirable vibrations and movements when the drum is rotated at spin speeds.

SUMMARY OF THE INVENTION

A method and apparatus for operating a laundry treating appliance by reducing a rotational speed of a treating chamber, without ceasing the rotation of the treating chamber, when an imbalance is present, while monitoring the magnitude of the imbalance during the reduction of the rotational speed, and increasing the rotational speed of the treating chamber back to a spin speed in response to a reduction in the magnitude of the imbalance.

DESCRIPTION OF AN EMBODIMENT OF THE INVENTION

Figure 1:
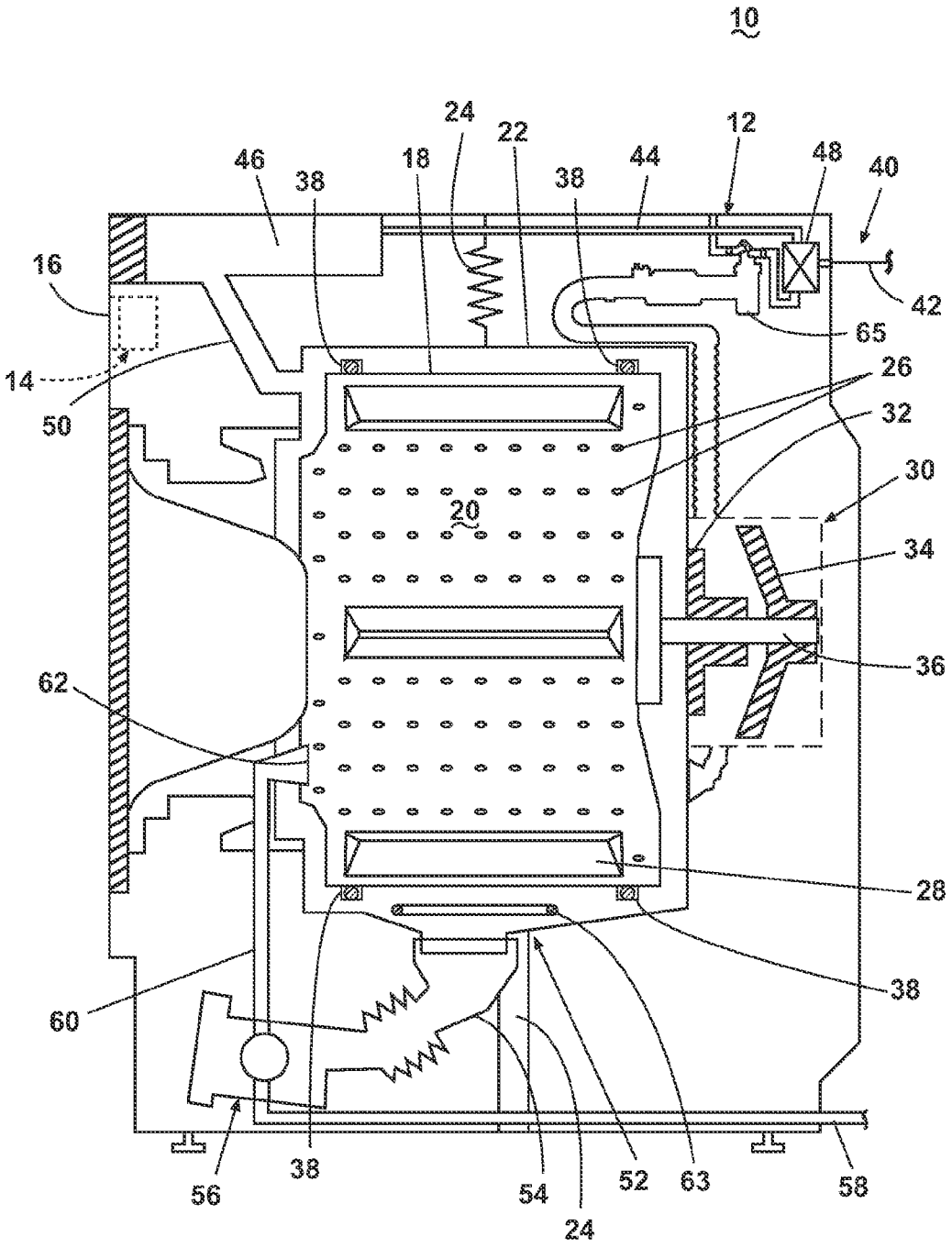
FIG. 1 is a sectional view of a laundry treating appliance according to one embodiment of the invention.

FIG. 1 illustrates one embodiment of the invention of a laundry treating appliance in the form of a washing machine 10 according to one embodiment of the invention. The laundry treating appliance may be any machine that treats articles such as clothing or fabrics. Non-limiting examples of the laundry treating appliance may include a horizontal or vertical axis washing machine; a horizontal or vertical axis dryer; a refreshing/revitalizing machine; an extractor; a non-aqueous washing apparatus; and a revitalizing machine. The washing machine 10 described herein shares many features of a traditional automatic washing machine, which will not be described in detail except as necessary for a complete understanding of the invention.

The washing machine 10 may include a cabinet 12, which may be a frame to which decorative panels are mounted. A controller 14 may be provided on the cabinet and controls the operation of the washing machine 10 to implement a cycle of operation. A user interface 16 may be included with the controller 14 to provide communication between the user and the controller. The user interface 16 may include one or more knobs, switches, displays, and the like for communicating with the user, such as to receive input and provide output.

A rotatable drum 18 may be disposed within the interior of the cabinet 12 and defines a treating chamber 20 for treating laundry. The rotatable drum 18 may be mounted within an imperforate tub 22, which is suspended within the cabinet 12 by a resilient suspension system 24. The drum 18 may include a plurality of perforations 26, such that liquid may flow between the tub 22 and the drum 18 through the perforations 26. The drum 18 may further include a plurality of lifters 28 disposed on an inner surface of the drum 18 to lift a laundry load 80 contained in the laundry treating chamber 20 while the drum 18 rotates.

While the illustrated washing machine 10 includes both the tub 22 and the drum 18, with the drum 18 defining the laundry treating chamber 20, it is within the scope of the invention for the washing machine 10 to include only one receptacle, with the receptacle defining the laundry treating chamber for receiving a laundry load to be treated.

A motor 30 is provided to rotate the drum 18. The motor 30 includes a stator 32 and a rotor 34, which is mounted to a drive shaft 36 extending from the drum 18 for selective rotation of the treating chamber 20 during a cycle of operation. It is also within the scope of the invention for the motor 30 to be coupled with the drive shaft 36 through a drive belt and/or a gearbox for selective rotation of the treating chamber 20.

The motor 30 may be any suitable type of motor for rotating the drum 18. In one example, the motor 30 may be a brushless permanent magnet (BPM) motor having a stator 32 and a rotor 34. Other motors, such as an induction motor or a permanent split capacitor (PSC) motor, may also be used. The motor 30 may rotate the drum 18 at various speeds in either rotational direction.

The washing machine 10 may also include at least one balance ring 38 containing a balancing material moveable within the balance ring 38 to counterbalance an imbalance that may be caused by laundry in the treating chamber 20 during rotation of the drum 18. The balancing material may be in the form of metal balls, fluid or a combination thereof. The balance ring 38 may extend circumferentially around a periphery of the drum 18 and may be located at any desired location along an axis of rotation of the drum 18. When multiple balance rings 38 are present, they may be equally spaced along the axis of rotation of the drum 18.

The washing machine 10 of FIG. 1 may further include a liquid supply and recirculation system 40. Liquid, such as water, may be supplied to the washing machine 10 from a water supply 42, such as a household water supply. A supply conduit 44 may fluidly couple the water supply 42 to the tub 22 and a treatment dispenser 46. The supply conduit 44 may be provided with an inlet valve 48 for controlling the flow of liquid from the water supply 42 through the supply conduit 44 to either the tub 22 or the treatment dispenser 46. The dispenser 46 may be a single-use dispenser, that stores and dispenses a single dose of treating chemistry and must be refilled for each cycle of operation, or a multiple-use dispenser, also referred to as a bulk dispenser, that stores and dispenses multiple doses of treating chemistry over multiple executions of a cycle of operation.

A liquid conduit 50 may fluidly couple the treatment dispenser 46 with the tub 22. The liquid conduit 50 may couple with the tub 22 at any suitable location on the tub 22 and is shown as being coupled to a front wall of the tub 22 in FIG. 1 for exemplary purposes. The liquid that flows from the treatment dispenser 46 through the liquid conduit 50 to the tub 22 typically enters a space between the tub 22 and the drum 18 and may flow by gravity to a sump 52 formed in part by a lower portion of the tub 22. The sump 52 may also be formed by a sump conduit 54 that may fluidly couple the lower portion of the tub 22 to a pump 56. The pump 56 may direct fluid to a drain conduit 58, which may drain the liquid from the washing machine 10, or to a recirculation conduit 60, which may terminate at a recirculation inlet 62. The recirculation inlet 62 may direct the liquid from the recirculation conduit 60 into the drum 18. The recirculation inlet 62 may introduce the liquid into the drum 18 in any suitable manner, such as by spraying, dripping, or providing a steady flow of the liquid.

Additionally, the liquid supply and recirculation system 40 may differ from the configuration shown in FIG. 1, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid. Further, the liquid supply and recirculation system 40 need not include the recirculation portion of the system or may include other types of recirculation systems.

A heater, such as sump heater 63 or steam generator 65, may be provided for heating the liquid and/or the laundry.

Figure 2:
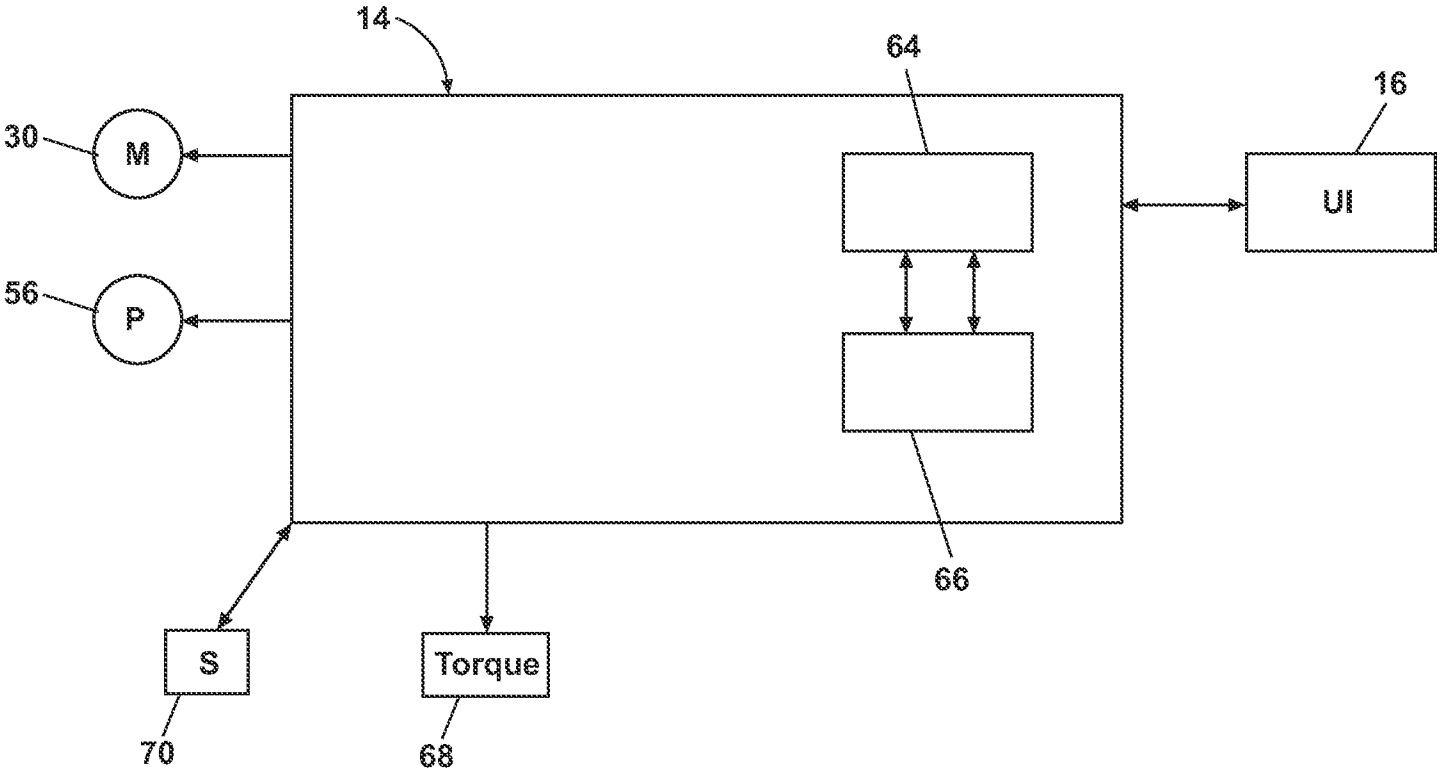
FIG. 2 is a schematic view of a controller of the laundry treating appliance of FIG. 1.

As illustrated in FIG. 2, the controller 14 may be provided with a memory 64 and a central processing unit (CPU) 66. The memory 64 may be used for storing the control software in the form executable instructions that is executed by the CPU 66 in executing one or more cycles of operation using the washing machine 10 and any additional software. The memory 64 may also be used to store information, such as a database or table, and to store data received from one or more components of the washing machine 10 that may be communicably coupled with the controller 14 as needed to execute the cycle of operation.

The controller 14 may be operably coupled with one or more components of the washing machine 10 for communicating with and controlling the operation of the component to complete a cycle of operation. For example, the controller 14 may be coupled with the user interface 16 for receiving user selected inputs and communicating information with the user, the motor 30 for controlling the direction and speed of rotation of the drum 18, and the pump 56 for draining and recirculating wash water in the sump 52. The controller 14 may also be operably coupled to the inlet valve 48, the steam generator 65, the sump heater 63, and the treatment dispenser 46 to control operation of the component for implementing the cycle of operation.

The controller 14 may also receive input from one or more sensors 70, which are known in the art. Non-limiting examples of sensors that may be communicably coupled with the controller 14 include: a treating chamber temperature sensor, a moisture sensor, a weight sensor, a drum position sensor, a motor torque sensor 68 and a motor speed sensor.

The dedicated motor torque sensor 68 may also include a motor controller or similar data output on the motor 30 that provides data communication with the motor 30 and outputs motor characteristic information, generally in the form of an analog or digital signal, to the controller 14 that is indicative of the applied torque. The controller 14 may use the motor characteristic information to determine the torque applied by the motor 30 using software that may be stored in the controller memory 64. Specifically, the torque sensor 68 may be any suitable sensor, such as a voltage or current sensor, for outputting a current or voltage signal indicative of the current or voltage supplied to the motor 30 to determine the torque applied by the motor 30. Additionally, the sensor may be a physical sensor or may be integrated with the motor and combined with the capability of the controller 14, may function as a sensor. For example, motor characteristics, such as speed, current, voltage, torque etc., may be processed such that the data provides information in the same manner as a separate physical sensor. In contemporary motors, the motors often have their own controller that outputs data for such information.

The previously described washing machine 10 may be used to implement one or more embodiments of a method of the invention. The embodiments of the method function to reduce the rotational speed of the treating chamber 20, without ceasing rotation, when a laundry imbalance is determined to be present, monitoring the imbalance during the speed reduction, and then increasing the rotational speed of the treating chamber 20 back to a spin speed when the imbalance has been determined to have been sufficiently eliminated.

Prior to describing a method of operation, a brief summary of the underlying physical phenomena is useful to aid in the overall understanding. The motor 30 may rotate the drum 18 at various speeds in either rotational direction. In particular, the motor 30 can rotate the drum 18 at speeds to effect various types of laundry load 80 movement inside the drum 18. For example, the laundry load may undergo at least one of tumbling, rolling (also called balling), sliding, satellizing (also called plastering), and combinations thereof. During tumbling, the drum 18 is rotated at a tumbling speed such that the fabric items in the drum 18 rotate with the drum 18 from a lowest location of the drum 18 towards a highest location of the drum 18, but fall back to the lowest location before reaching the highest location. Typically, the centrifugal force applied by the drum to the fabric items at the tumbling speeds is less than about 1G. During satellizing, the motor 30 may rotate the drum 18 at rotational speeds, i.e. a spin speed, wherein the fabric items are held against the inner surface of the drum and rotate with the drum 18 without falling. This is known as the laundry being satellized or plastered against the drum. Typically, the force applied to the fabric items at the satellizing speeds is greater than or about equal to 1G. For a horizontal axis washing machine 10, the drum 18 may rotate about an axis that is inclined relative to the horizontal, in which case the term "1G" refers to the vertical component of the centrifugal force vector, and the total magnitude along the centrifugal force vector would therefore be greater than 1G. The terms tumbling, rolling, sliding and satellizing are terms of art that may be used to describe the motion of some or all of the fabric items forming the laundry load. However, not all of the fabric items forming the laundry load need exhibit the motion for the laundry load to be described accordingly. Further, the rotation of the fabric items with the drum 18 may be facilitated by the baffles 28.

Centrifugal force (CF) is a function of a mass (m) of an object (laundry item 84), an angular velocity (ω) of the object, and a distance, or radius (r) at which the object is located with respect to an axis of rotation (X), or a drum axis. Specifically, the equation for the centrifugal force (CF) acting on a laundry item 84 within the drum 18 is:

$$CF=m*\omega^2*r$$

The centrifugal force (CF) acting on any single item 84 in the laundry load 80 can be modeled by the distance the center of gravity of that item 84 is from the axis of rotation (X) of the drum 18. Thus, when the laundry items 84 are stacked upon each other, which is often the case, those items having a center of gravity closer to the axis of rotation (X) experience a smaller magnitude centrifugal force (CF) that those items having a center of gravity farther away. It is possible to slow the speed of rotation of the drum 18 such that the closer items 84 will experience a centrifugal force (CF) less than 1G, permitting them to tumble, while the farther away items 84 still experience a centrifugal force (CF) equal to or greater than 1G, retaining them in a fixed position relative to the drum 18. Using such a control of the speed of the drum 18, it is possible to control the speed of the drum 18 such that the closer items 84 may tumble within the drum 18 while the farther items 84 remain fixed. This method may be used to eliminate an imbalance 82 caused by a mass of stacked laundry items 84.

As used in this description, the elimination of the imbalance 82 means that the imbalance 82 is reduced an amount suitable for the operating conditions. It does not require a complete removal of the imbalance 82. In many cases, the suspension system 24 in the washing machine 10 may accommodate a certain amount of imbalance 82. Thus, it is not necessary to completely remove the entire imbalance 82.

Figure 3:
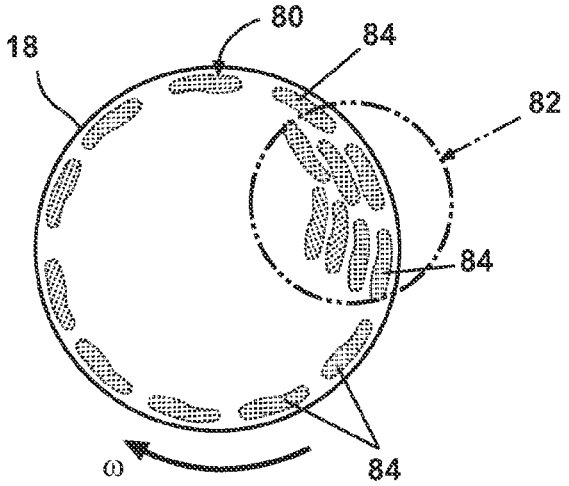
FIG. 3 illustrates the position of a laundry load, including an imbalance, in a drum of the laundry treating appliance of FIG. 1, during a spin phase of a cycle of operation.
Figure 4:
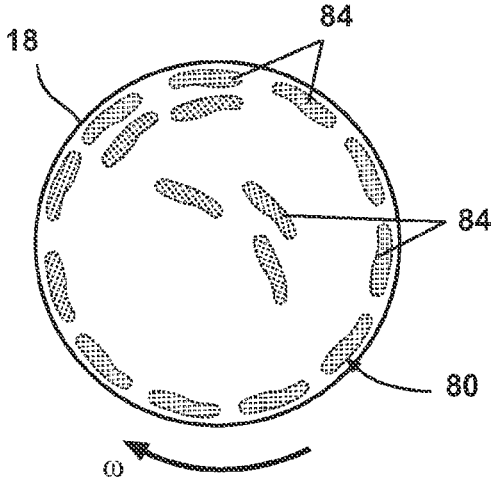
FIG. 4 illustrates the position of the laundry load in the drum during a redistribution phase of the cycle of operation.
Figure 5:
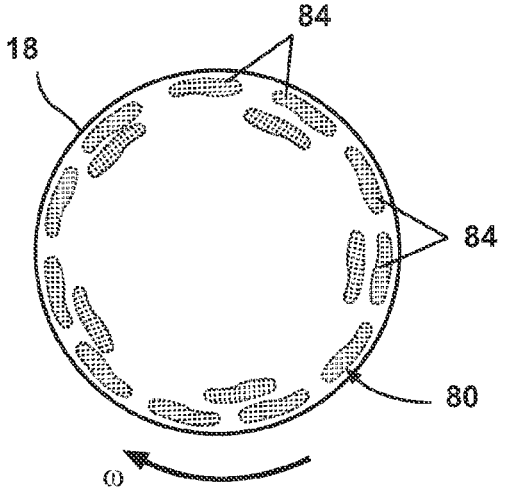
FIG. 5 illustrates the position of the laundry load in the drum during the spin phase of the cycle of operation after the imbalance has been sufficiently eliminated.

FIGS. 3-5 graphically illustrate such a method. Beginning with FIG. 3, an unequally distributed laundry load 80 is shown in the treating chamber 20 defined by the drum 18 during a spin phase wherein the treating chamber 20 is rotated at a spin speed sufficient to apply a centrifugal force greater than 1G to the entire laundry load 80, thereby, satellizing the laundry load 80. However, it can also be seen that not all the laundry items 84 that make up the laundry load 80 are located an equal distance from the axis of rotation (X). Following the above equation, the centrifugal force (CF) acting on each laundry item 84 in the treating chamber 20 is proportional to the distance from the axis of rotation (X). Thus, along the radius (R) of the treating chamber 20, the centrifugal force (CF) exhibited on the individual laundry items 84 will vary. Accordingly, the closer the laundry item 84 lies to the axis of rotation (X) (the smaller the radius (r)), the smaller the centrifugal force (CF) acting thereon. Therefore, to satellize all of the laundry items 84, the treating chamber 20 must be rotated at a spin speed sufficient that the centrifugal force (CF) acting on all of the laundry items 84 is greater than the gravity force acting thereon. It can be correlated that the laundry items 84 pressed against the inner peripheral wall of the treating chamber 20 experience greater centrifugal force (CF) than the laundry items 84 lying closer to the axis of rotation (X). In other words, during the spin phase and satellization of the laundry load 80, all of the laundry items 84 are experiencing centrifugal force greater than 1G, yet not all of the laundry items 84 are experiencing the same centrifugal force (CF).

The imbalance 82 can be seen in the treating chamber 20, as circled in FIG. 3. The imbalance 82 is due to the uneven distribution of the laundry items 84 within the treating chamber 20. Further, the laundry items 84 that create the imbalance 82 will necessarily be those laundry items 84 that are closest to the axis of rotation (X).

FIG. 4 illustrates the position of the laundry load 80 in the treating chamber 20 during a redistribution phase wherein the treating chamber 20 is slowed from the speed of FIG. 3 and rotated at a speed such that some of the laundry items 84 experience less than 1G of centrifugal force, while the remaining laundry items 84 experience 1G or greater of centrifugal force. According to the principals described above, as the rotational speed of the treating chamber 20 is reduced, the laundry item 84 or items that contributed to the imbalance 82 will begin to tumble and will be redistributed.

Upon redistribution, the treating chamber 20 may be accelerated once again to a speed sufficient to satellize all of the laundry items 84. FIG. 5 illustrates the position where the imbalance 82 is eliminated by a sufficient redistribution and the rotational speed of the treating chamber 20 has been increased again to the spin speed sufficient to satellize the entire laundry load 80.

According to one embodiment of the invention, the presence of an imbalance 82 may be determined, as illustrated in FIG. 3, and the rotational speed of the treating chamber 20 may be reduced to initiate redistribution of the imbalance 82, defining the redistribution phase, as illustrated in FIG. 4. During the redistribution phase, the magnitude of the imbalance 82 may be determined and monitored. Specifically, the magnitude of the imbalance 82 may be determined, and then monitored, by analyzing a signal indicative of the torque of the motor 30 in the frequency domain. It has been discovered that analysis of the motor torque signal in the frequency domain provides valuable information regarding the imbalance 82, especially as compared to analysis of the motor torque signal in the time domain. The analysis of the motor torque signal in the frequency domain may be done by the controller 14 processing the motor torque signal from the torque sensor 68 using a mathematical method, such as a Fast Fourier Transform (FFT) or a Sliding Discrete Fourier Transform (SDFT).

Figure 6:
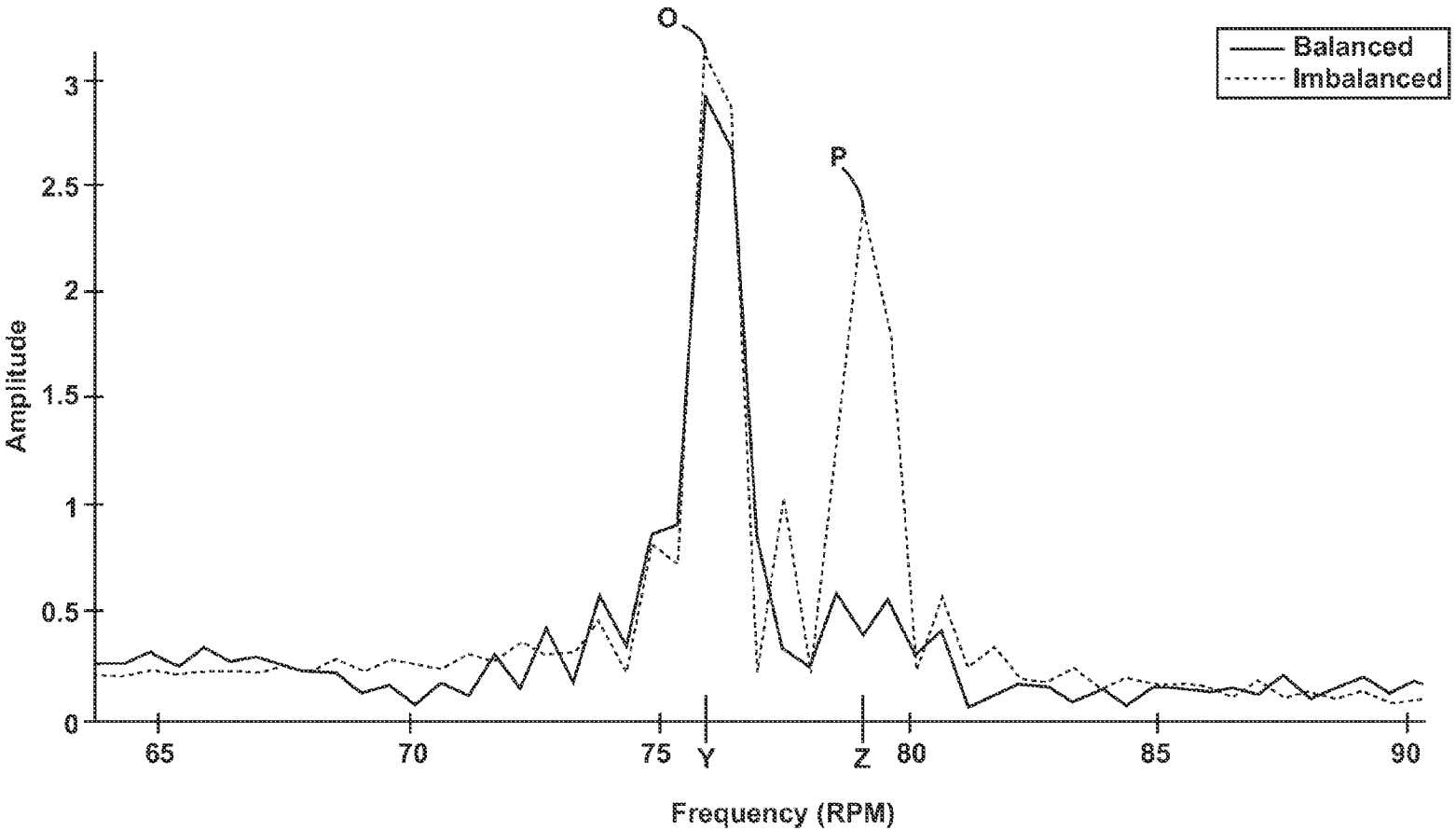
FIG. 6 is a graph of motor torque of a motor that drives the drum from the laundry treating appliance of FIG. 1, wherein the motor torque is shown in a frequency domain.

Referring now to FIG. 6, a graph of the motor torque signal shown in the frequency domain is illustrated. FIG. 6 is a snapshot of the frequency response of the motor torque signal when the drum 18 is rotated at a specific speed. The graph includes two sets of overlaid data: the amplitude of the frequency response for a balanced load (B), shown as a solid line, and an imbalanced load (I), shown as a dashed line. A significant peak (O) in both the balanced load (B) and the imbalanced load (I) can be seen at a frequency (Y), which is the frequency associated with the movement of the balancing material in the balancing ring(s) 38. This information is not useful, however, because both the balanced load (B) and the imbalanced load (I) peak at frequency (Y) with magnitudes that are not appreciably different for the given environment.

At a frequency (Z), which is approximately the rotational speed of the drum 18, a second and useful peak (P) can be seen. It has been found that the imbalanced load (I) has a large and readily apparent peak (P) at frequency (Z) that exists for the imbalanced load (I), but does not exist for the balanced load (B). This second peak (P) at frequency (Z) is directly attributed to the imbalance 82 of the laundry load 80. Thus, an imbalance 82 may be detected by the controller 14 though analysis of the motor torque signal in the frequency domain. More specifically, the motor torque signal can be viewed in the frequency domain to determine if the peak (P) exists at a frequency approximately that of the rotational speed of the drum 18. If the peak (P) does exist, the controller 14 may determine that an imbalance 82 is present.

The data shows that even the balanced load (B) has some minor peaks as compared to the peak (P) of the imbalanced load. Thus, a practical implementation of a control based on this approach may use a threshold peak value, which may be determined experimentally, to determine when the magnitude of the peak is sufficient to be indicative of an imbalance 82, such as peak (P). When the magnitude of the peak (P) satisfies the threshold value, such as being above the threshold value, the imbalance 82 may be determined to be present. The threshold value for the magnitude of the peak (P) may be selected in light of the characteristics of a given machine. For example, such a threshold may be a function of the imbalance 82 that the suspension system 24 can accommodate.

Figure 7:
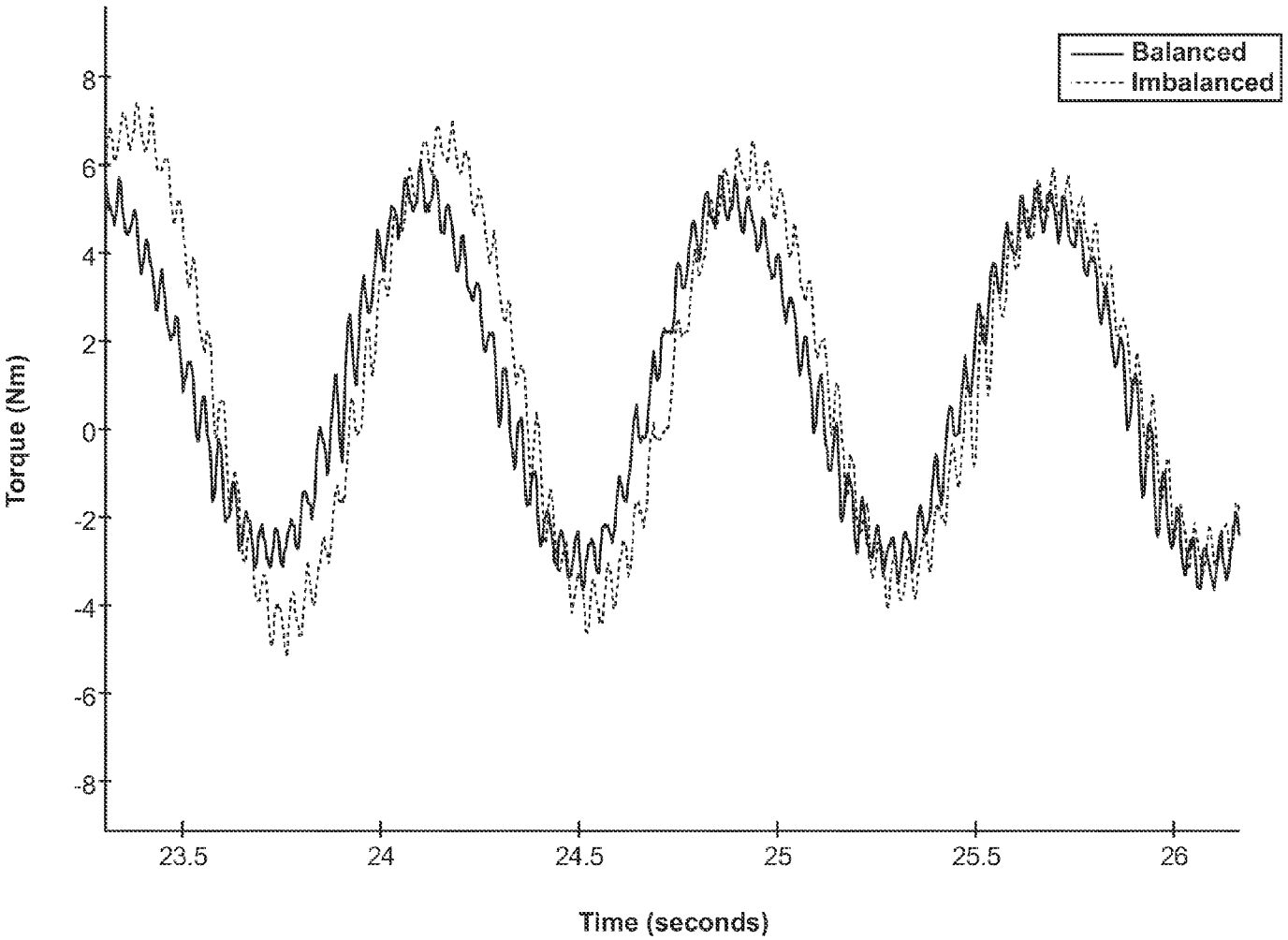
FIG. 7 is a graph of motor torque of a motor that drives the drum from the laundry treating appliance of FIG. 1, wherein the motor torque is shown in a time domain.

A benefit of analyzing the torque data in the frequency domain is that the component of the signal attributable to the balancing ring(s) 38 is easily distinguishable from the component of the signal attributable to the imbalance 82, which is not the case when analyzing the data in the time domain. FIG. 7 is a graph of the motor torque signal used for FIG. 6 but shown in the time domain. The graph includes two sets of overlaid data: the torque reading for a balanced load (solid line) and an imbalanced load (dashed line). The motor torque signal in the time domain displays a sinusoidal pattern, the frequency of which is related to the rotational speed of the drum 18. As can be seen, there is no significant difference between the torque signal for the balanced and imbalanced loads, which is due in large part to the effect of the balance rings 38. As such, no clear or useful content related to the laundry load 80 in the drum 18 can readily be seen in the time domain.

In fact, the balance ring(s) 38 add noise to the torque signal that makes it difficult or impossible to process the torque data in the time domain to monitor the imbalance 82. The commercial use of balance ring(s) 38 is relatively new and, while providing a useful balancing function, has interfered with processing the torque signal in the time domain.

Figure 8:
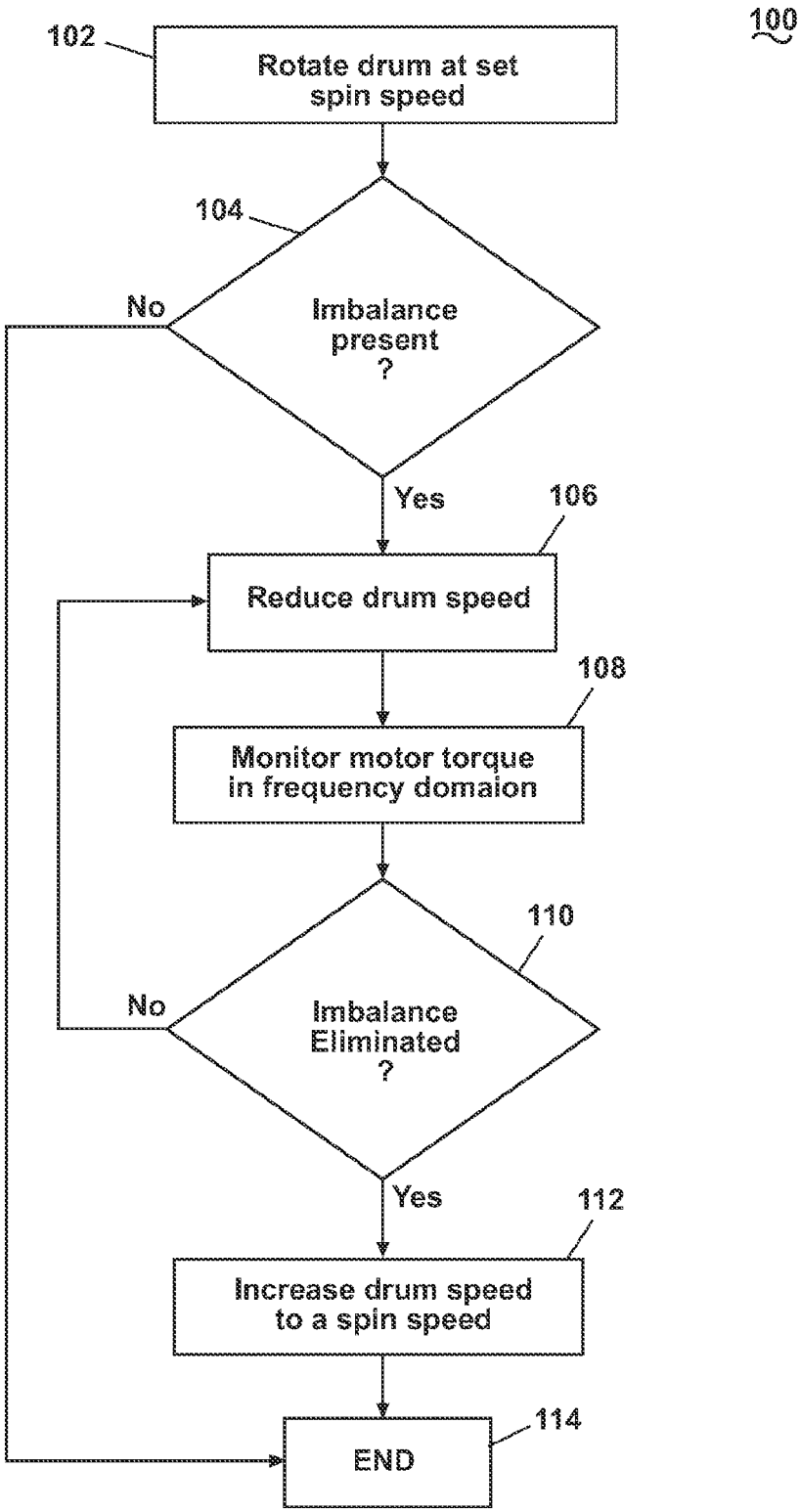
FIG. 8 is a flow chart illustrating a redistribution method for redistributing an imbalance according to an embodiment of the invention.

FIG. 8 illustrates a flow chart corresponding to a method of operating the washing machine 10 using a redistribution method based on the above described phenomena as implemented during the cycle of operation according to one embodiment of the invention. The redistribution method 100 may be implemented in any suitable manner, such as automatically or manually, as a stand-alone phase or cycle of operation or as a phase of an operation cycle of the washing machine 10. The cycle of operation may include other individual cycles or phases, such as a wash phase and/or a rinse phase, or the cycle of operation may have only the redistribution method 100. When the cycle of operation includes other individual phases, the redistribution method 100 may function as an intermediate redistribution phase, a final redistribution phase, or other type of redistribution phase. Regardless of the implementation of the redistribution method 100, the redistribution method 100 may be employed to eliminate or reduce an imbalance 82 from the laundry load 80 in the treating chamber 20.

The redistribution method 100 begins with a first spin at 102 that comprises rotating the drum 18 at a spin speed, which is a rotational speed sufficient to apply at least a 1G centrifugal force to the laundry items 84 in the drum 18.

At 104, while the drum 18 is rotating at the spin speed, the presence of an imbalance 82 may be determined by the controller 14. In determining the presence of an imbalance 82, it may be desirable to determine the presence of imbalances 82 greater than a predetermined threshold as some imbalance 82 is permissible under normal operating conditions. The term "satisfies" the threshold is used here to mean the value compared to the threshold or reference value meets the desired criteria of the comparison because the criteria and threshold values may easily be altered to be satisfied by a positive/negative comparison or a true/false comparison.

The determination of the presence of an imbalance 82 may be made in several ways. It may be determined using accelerometers or load sensors, which may be one of the sensors 70. It may also be determined by the time domain torque signal, which is still useful for determining the presence of an imbalance 82, but not as useful for determining the magnitude of the imbalance 82. Another example of which is by analyzing a motor characteristic signal indicative of the motor torque in the frequency domain as described above.

If an imbalance 82 is determined to be present, the rotational speed of the drum 18 may be reduced to initiate a redistribution phase, as at 106. As explained above, as the rotational speed of the drum 18 slows, the laundry items 84 that form the imbalance 82 (those which are closest to the axis of rotation (X)) will begin to tumble and will redistribute more evenly along the periphery of the drum 18. Further, the rotational speed of the drum 18 is reduced, but never ceased, such that part of the laundry load 80 is applied a centrifugal force (F) greater than 1G while simultaneously another part of the laundry load 80, the imbalance 82, is applied a centrifugal force less than 1G. That is to say that part of the laundry load 80 will remain satellized, but the imbalance 82 will tumble and be redistributed.

Additionally, at 106, the rotational speed of the drum 18 may be slowly decreased so as to prevent the reduction of the rotational speed too far below what is needed for redistribution. For example, the rotational speed of the drum 18 may be reduced at a deceleration rate of less than 10 rpm/s. In another example, the rotational speed of the drum 18 may be reduced at a deceleration rate between 1 and 5 rpm/s. In yet another example, the rotational speed of the drum 18 may be reduced at a deceleration rate less than 1 rpm/s. The rate of the reduction may be selected to prevent overshooting the lowest speed needed for redistribution while not undesirably extending the cycle time.

At 108, while the rotational speed of the drum 18 is slowly decreased, the controller 14 may monitor the magnitude of the imbalance 82. While the magnitude of the imbalance 82 may be determined using any of the previously described methods, such as by using outputs from accelerometers or load sensors, the magnitude may be monitored by the torque signal to avoid the addition of another sensor. If the torque signal is to be used for the monitoring, analyzing the motor torque signal in the frequency domain, as described above, at a frequency (Z), is the more robust approach as it removes extraneous noise related to the balancing ring(s) 38. The process of determining the magnitude of the imbalance 82 at 108 includes reading the motor torque signal from the torque sensor 68 and communicating the motor torque signal to the controller 14. The controller 14 may then convert the motor torque signal to the frequency domain to obtain a value representative of the magnitude of the imbalance 82. Monitoring occurs by determining the magnitude of the imbalance 82 either continuously or at set intervals. Additionally, the magnitude value information may be stored in the memory 64.

At 110, the controller 14 may determine if the magnitude of the imbalance 82 has been sufficiently eliminated. The determination at 110 is made by comparing the monitored magnitude of the imbalance 82 to a predetermined threshold value. The controller 14 compares the monitored magnitude of the imbalance 82, either continuously or at set time intervals, to the predetermined threshold value. As described above, the controller 14 may comprise a real-time frequency domain processing function for processing the motor torque signal.

When the magnitude of the imbalance 82 satisfies the predetermined threshold, such as being below the threshold value, the imbalance 82 may be determined to have been sufficiently eliminated. Thus, as the rotational speed of the drum 18 is slowly decreased, the comparison is made either repeatedly or continuously, such that as redistribution of the imbalance 82 occurs, the sufficient elimination of the imbalance 82 will be determined right away.

Once the imbalance 82 is determined to have been eliminated, the rotational speed of the drum 18 is increased to a spin speed, such as an extraction speed, as at 112. The redistribution method 100 then ends at 114, and control passes back to the controller 14 to implement the rest, if any, of the cycle of operation.

If, at any time thereafter, an imbalance 82 is determined to be present, the rotational speed of the drum 18 may be reduced, and control may be passed back to 104 to implement a new redistribution phase and the redistribution method 100 is repeated. This process is repeated until the imbalance is sufficiently eliminated or the cycle of operation is completed.

A benefit of the redistribution method 100 lies in not ceasing the rotation of the drum 18. Reducing the rotational speed of the drum 18 rather than stopping the drum 18, as in some prior methods, efficiently redistributes the imbalance 82 in the laundry load 80, thereby, saving energy because the motor 30 does not need to be restarted from zero rotational speed. Because the method of the invention redistributes only part of the load 80, it further reduces the likelihood of the formation of a new imbalance 82 at a different location, which can happen with the prior methods where the entire load 80 is tumbled to eliminate the imbalance 82. Additionally, the method of the invention reduces the overall cycle time because monitoring the magnitude of the imbalance leads to determining that the imbalance is sufficiently eliminated sooner than prior methods in which the redistribution phase was maintained for a given time period. The cycle time is also reduced because the imbalance is eliminated without stopping the rotation of the drum, and the drum need only be slowed as much as necessary to remove the imbalance. With the redistribution method 100, as soon as the imbalance is determined to have been sufficiently eliminated, the cycle of operation may immediately continue. In summary, with the method of the invention, the redistribution phase may be reduced and the drum is not stopped, which leads to improved energy consumption and shorter cycle times.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method for operating a laundry treating appliance having a rotating treating chamber for receiving laundry for treatment, a motor rotating the treating chamber, and a controller operably coupled to the motor to control the rotation of the treating chamber according to a cycle of operation, the method comprising:

a) rotating the treating chamber at a spin speed, which is a rotational speed sufficient to satellize the laundry in the treating chamber;

b) determining a presence of an imbalance in the laundry;

c) reducing the rotational speed of the treating chamber without ceasing the rotation of the treating chamber when the presence of an imbalanced is determined;

d) monitoring the magnitude of the imbalance in a frequency domain during the reducing of the rotational speed; and e) increasing the rotational speed of the treating chamber to a spin speed in response to a reduction in the magnitude of the imbalance.

2. The method of claim 1 wherein reducing the rotational speed of the treating chamber without ceasing rotation comprises reducing the rotational speed such that part of the laundry is satellized while simultaneously another part of the laundry is tumbled.

3. The method of claim 2 wherein the another part of the laundry includes a part of the laundry forming the imbalance.

4. The method of claim 1 wherein reducing the rotational speed of the treating chamber without ceasing rotation comprises reducing the rotational speed at a deceleration rate of less than 10 rpm/s.

5. The method of claim 4 wherein the deceleration rate is between 1 and 5 rpm/s.

6. The method of claim 4 wherein the deceleration rate is less than 1 rpm/s.

7. The method of claim 1 wherein monitoring the magnitude of the imbalance comprises monitoring in a frequency domain a signal indicative of a torque of the motor.

8. The method of claim 7 wherein monitoring the signal in the frequency domain comprises monitoring a frequency representative of the rotational speed of the treating chamber.

9. The method of claim 8 wherein a reduction in the magnitude of the imbalance comprises a decrease in the magnitude at the frequency representative of the rotational speed of the treating chamber.

10. The method of claim 9 wherein a reduction in the magnitude of the imbalance comprises the decrease in the magnitude at the frequency representative of the rotational speed of the treating chamber satisfying a predetermined threshold.

11. The method of claim 7 wherein determining the presence of an imbalance comprises monitoring in the frequency domain a signal indicative of the torque of the motor.

12. The method of claim 1 wherein when an imbalance is present, steps c-e are repeated.

13. The method of claim 12 wherein the imbalance is present when an amount of the imbalance exceeds a predetermined threshold.

14. The method of claim 1 wherein increasing the rotational speed of the treating chamber to a spin speed comprises increasing the rotational speed of the treating chamber to an extraction speed.

* * * * *